US009790907B2

(12) United States Patent
Maier et al.

(10) Patent No.: US 9,790,907 B2
(45) Date of Patent: Oct. 17, 2017

(54) INJECTION DEVICE FOR AN INTERNAL COMBUSTION ENGINE

(71) Applicant: Bayerische Motoren Werke Aktiengesellshaft, Munich (DE)

(72) Inventors: Bernhard Maier, Bruckberg (DE); Norbert Klauer, Haimhausen (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 14/720,401

(22) Filed: May 22, 2015

(65) Prior Publication Data

US 2015/0252762 A1 Sep. 10, 2015

Related U.S. Application Data

(63) Continuation of application No. PCT/EP2013/072261, filed on Oct. 24, 2013.

(30) Foreign Application Priority Data

Nov. 26, 2012 (DE) ..... 10 2012 221 524

(51) Int. Cl.
*F02M 51/00* (2006.01)
*F02M 51/06* (2006.01)
*F02M 55/00* (2006.01)

(52) U.S. Cl.
CPC .... *F02M 51/0625* (2013.01); *F02M 51/0685* (2013.01); *F02M 55/008* (2013.01); *F02M 2200/02* (2013.01); *F02M 2200/29* (2013.01)

(58) Field of Classification Search
CPC ..... F02M 51/0625; F02M 51/0685; F02M 55/008
USPC ..... 239/461, 463, 585.4, 585.5
See application file for complete search history.

(56) References Cited

U.S. PATENT DOCUMENTS

| | | | | |
|---|---|---|---|---|
| 3,567,135 | A | 3/1971 | Gebert | |
| 4,575,009 | A | 3/1986 | Giraudi | |
| 6,799,734 | B1 | 10/2004 | Hans | |
| 7,131,426 | B2 * | 11/2006 | Ichinose | F02M 59/34 123/446 |

(Continued)

FOREIGN PATENT DOCUMENTS

| | | | |
|---|---|---|---|
| CN | 100402830 | C | 7/2008 |
| CN | 201874713 | U | 6/2011 |

(Continued)

OTHER PUBLICATIONS

International Search Report dated Jan. 23, 2014 (Four (4) pages).

(Continued)

*Primary Examiner* — Arthur O Hall
*Assistant Examiner* — Viet Le
(74) *Attorney, Agent, or Firm* — Crowell & Moring LLP

(57) ABSTRACT

The invention relates to an injection device for an internal combustion engine, comprising a needle and an armature, which is operatively connected to the needle in such a way that a movement of the needle can be produced by movement of the armature, the armature having at least one passage bore, through which fuel can be conducted to a needle tip, characterized in that a longitudinal axis of the needle and a longitudinal axis of the passage bore are oriented askew in relation to each other.

13 Claims, 2 Drawing Sheets

(56) References Cited

U.S. PATENT DOCUMENTS

2004/0261771 A1 12/2004 Ichinose et al.

FOREIGN PATENT DOCUMENTS

| | | | |
|---|---|---|---|
| DE | 199 50 761 | A1 | 4/2001 |
| DE | 10 2010 030 393 | A1 | 12/2011 |
| DE | 10 2011 004 186 | A1 | 8/2012 |
| EP | 0 195 948 | A2 | 10/1986 |
| EP | 1 347 472 | A2 | 9/2003 |
| EP | 1 602 821 | A1 | 12/2005 |
| EP | 2 322 797 | A1 | 5/2011 |
| JP | 2010-169040 | A | 8/2010 |

OTHER PUBLICATIONS

German Search Report dated Oct. 9, 2013 with Statement of Relevancy (Six (6) pages).
Chinese Office Action issued in Chinese counterpart application No. 201380049830.7 dated Jul. 27, 2016, with English translation (Eleven (11) pages).

* cited by examiner

INJECTION DEVICE FOR AN INTERNAL COMBUSTION ENGINE

CROSS REFERENCE TO RELATED APPLICATIONS

This application is a continuation of PCT International Application No. PCT/EP2013/072261, filed Oct. 24, 2013, which claims priority under 35 U.S.C. §119 from German Patent Application No. 10 2012 221 524.7, filed Nov. 26, 2012, the entire disclosures of which are herein expressly incorporated by reference.

BACKGROUND AND SUMMARY OF THE INVENTION

The invention relates to an injection device, having a needle and having an armature which is connected to the needle such that a movement of the needle can be generated by way of a movement of the armature, wherein the armature has at least one passage bore through which fuel can be conducted to a needle tip.

For the operation of internal combustion engines, fuel and air is mixed and ignited, wherein the energy stored in the fuel is converted into mechanical work and then utilized for the propulsion of a motor vehicle. To supply the fuel to the air, use is made of injection units which are arranged either in the intake tract or in the combustion chamber of the internal combustion engine. In this regard, mechanical injection devices, piezoelectric injectors and coil-type injectors are known from the prior art. In this case, there is arranged in the interior of an injector housing a needle by means of which outlet openings provided in a housing can be opened and closed. In general, the needle moves in a linear direction of movement from an open position into a closed position and vice versa, such that in the open state, the fuel can flow through the outlet openings and is admixed to the air.

Such systems however have the disadvantage that, in the closed state of the injection device, the needle comes to lie on the housing at the same location. Contaminants, for example particles, entrained in the fuel are in this case forced against the internal wall of the housing by the needle. Said contaminants thus accumulate on the sealing surface between needle and housing and lead to leakages of the injection device. As a result, fuel can continue to pass through the outlet openings even when the needle is in the closed state. This disrupts the normal operation of the engine and leads to increased fuel consumption of the vehicle.

It is the object of the present invention to specify an injection device which overcomes the disadvantages presented in the prior art. In particular, it is an object of the invention to specify an injection device which exhibits high reliability and functional dependability and with which a high level of leak-tightness of the system is simultaneously realized.

Said object is achieved by means of a device having the features of the independent claim. The dependent claims relate to advantageous embodiments of the invention.

To achieve said object, the invention proposes an injection device for an internal combustion engine, having a needle, wherein the armature is operatively connected to the needle such that a movement of the needle can be generated by way of a movement of the armature, wherein the armature has at least one passage bore through which fuel can be conducted to a needle tip. Furthermore, the injection device may be characterized in that a longitudinal axis of the needle and a longitudinal axis of the passage bore are in a skewed orientation relative to one another. By means of this oblique orientation of the passage bore through the armature, the throughflow of fuel subjects the armature to a torque which acts about the longitudinal axis of the needle. Said torque is transmitted by friction to the needle, whereby a rotational movement of the needle is generated. During the closing process, the rotational momentum of the needle has the effect that contaminants are constantly rubbed away from the sealing surface.

Furthermore, the passage bore may comprise an inlet opening and an outlet opening in the armature, wherein the distance between the inlet opening and the longitudinal axis of the needle is smaller than the distance between the outlet opening and the longitudinal axis of the needle. In this way, the longitudinal axis of the passage bore lies in a plane which is oriented parallel to the longitudinal axis of the needle and which encloses an acute angle with a tangential plane of a circular path running around the longitudinal axis of the needle. Owing to the orientation of the passage bore, it is possible for rotational momentum to be imparted to the armature as the injection device opens, that is to say at the moment when the needle opens up the outlet opening of the injection device.

Furthermore, the armature may be arranged rotatably on the needle.

Furthermore, the armature may be arranged so as to be rotatable about the needle, wherein the needle is provided in a centrally arranged bore of the armature. This positioning of the needle in the armature yields a symmetrical overall construction, whereby particularly uniform and reproducible rotational movements of the armature, and thus also of the needle, can be generated.

In a preferred embodiment of the invention, the injection device is in the form of a coil-type injector.

Furthermore, the armature may have a multiplicity of passage bores, the inlet openings and outlet openings of which are arranged radially on a circular path around a longitudinal axis of the needle situated centrally in the armature, wherein the longitudinal axis of the passage bore encloses an acute angle with a tangential plane of the circular path. Through the provision of multiple passage bores, it is possible to realize a particularly good rotational movement of the armature, and thus of the needle, which can be repeated upon every injection process.

The angle between the tangential plane of the circular path and the longitudinal axis of the passage bore may lie in the range of +45° to −45°, preferably in the range of +30° to −30° and particularly preferably in the range of +15° to −15°. In this range, the fuel jet emerges from the passage bore and imparts an ideal action to the armature such that an optimum rotational movement of the armature about the longitudinal axis of the needle is generated.

Other objects, advantages and novel features of the present invention will become apparent from the following detailed description of one or more preferred embodiments when considered in conjunction with the accompanying drawings.

DETAILED DESCRIPTION OF THE DRAWINGS

The invention will be explained below on the basis of the description of the figures. The claims, the figures and the description contain a multiplicity of features which will be explained below in conjunction with embodiments of the present invention described by way of example. A person skilled in the art will also consider said features individually and in other combinations to form further embodiments which are adapted to corresponding uses of the invention.

Figure 1:
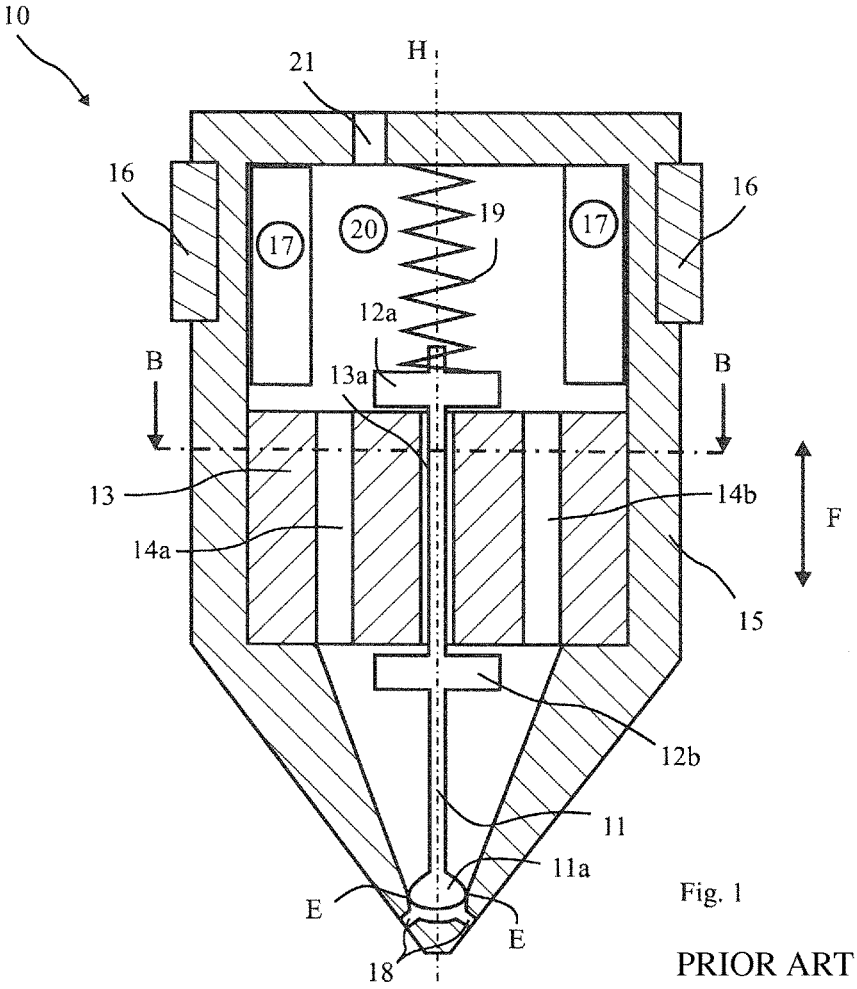
Fig. 1 PRIOR ART
FIG. 1 depicts a sectional view of the basic construction of a known injection device along the section plane A-A of FIG. 2.

The basic construction of a known injection device will be explained on the basis of FIG. 1. The injection device 10 has a housing 15 in which an armature 13 is provided. The armature 13 comprises a central bore 13*a* through which a needle 11 is guided. The needle 11 has stops 12*a* and 12*b* and a needle tip 11*a*, which in FIG. 1 is illustrated at the lower end of the needle 11. In the housing 15 there are provided outlet openings 18 via which fuel is delivered out of the interior of the housing 15 when the needle 11 is situated in an open position.

For the actuation of the injection device 10, that is to say for the transfer of the needle 11 from a closed position into an open position, a coil 16 is energized. Said coil generates a magnetic field which is boosted by the cores 17. This causes the armature 13 to be attracted upward along the double arrow F in FIG. 1. During said movement, the armature 13 comes into contact with the upper stop element 12*a* and drives the needle 11 along with it. The upward movement of the needle 11 and of the armature 13 is stopped when the armature 13 comes into contact with the core 17. Alternatively, other suitable stop elements may be provided for stopping the movement of the armature 13. To transfer the needle 11 into its closed position again, the energization of the coil 16 is stopped, and the magnetic field is thus eliminated. The spring 19 then exerts a spring force on the upper stop element 12*a* and thus pushes the needle 11 into the closed position. In this case, the needle tip 11*a* abuts against the housing 15 in the regions denoted by the letter E in FIG. 1. A substantially annular sealing surface is formed between the needle tip 11*a* and the housing 15.

As an alternative to the embodiment illustrated, the spring 19 may also act directly on the armature 13. In this case, the armature 13 moves downward and comes into contact with the lower stop element 12*b*. As a result, the armature 13, during its movement, drives the needle 11 along with it and transfers the latter into the closed position.

The path of the fuel will be described below. The fuel is conducted through the opening 21 from a fuel line (not illustrated) into the chamber 20 with the aid of a fuel delivery pump. From the central chamber 20, the fuel passes via the throughflow bores 14*a*, 14*b* into the tapering region below the armature 13. The delivery pump generates a corresponding pressure in the region that is flooded with fuel. When the needle 11 is transferred into an open position, the pressure prevailing in the chamber 20 causes the fuel to flow through the outlet openings 18 into a combustion chamber or into an intake tract of the internal combustion engine.

In the process, a flow is generated in which fuel flows from the chamber 20 through the inlet opening into the passage bore 14*a*, 14*b* and through the outlet opening from the passage bore into the region below the armature 13. FIG. 1 is a sectional illustration of the injection device along the section plane A-A from FIG. 2, and FIG. 2 is a sectional view along the section plane B-B from FIG. 1.

Figure 2:
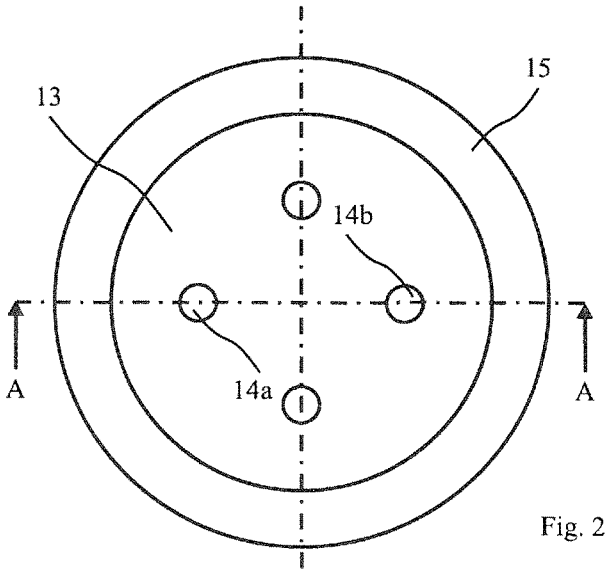
Fig. 2 PRIOR ART
FIG. 2 depicts a sectional view of the known injection device of FIG. 1 along the section plane B-B from FIG. 1.

As can be seen from FIGS. 1 and 2, in the prior art, the throughflow bores 14*a*, 14*b* are oriented such that their axial directions are oriented parallel to a central axis H of the needle 11 or of the central bore 13*a*.

Figure 3:
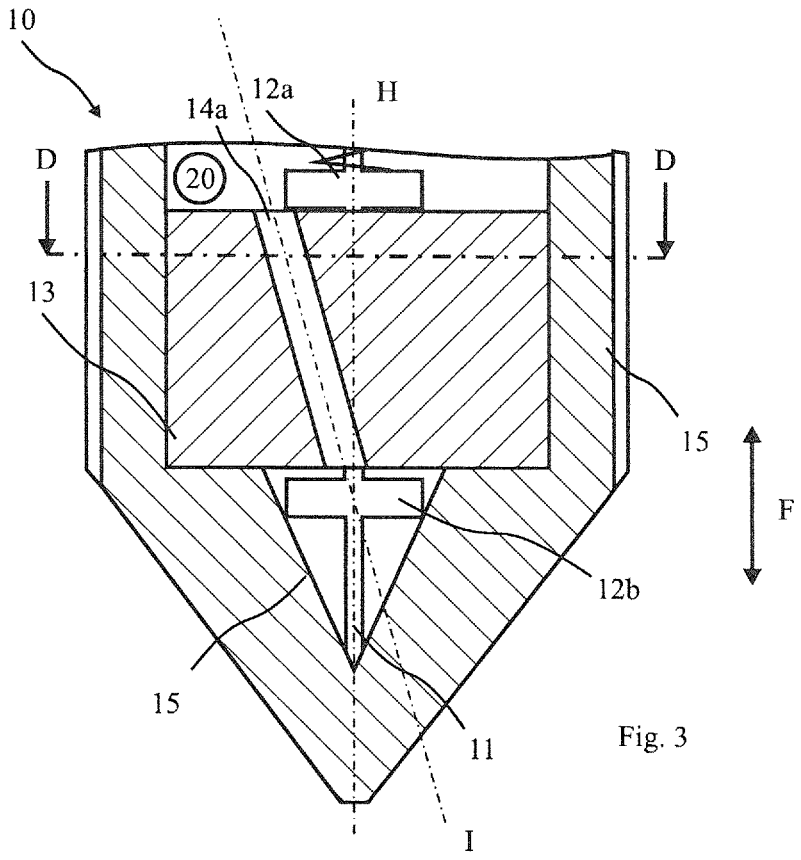
FIG. 3 depicts a sectional view, along the section plane C-C of FIG. 4, of an injection device configured in accordance with the principles of the invention.

On this basis, the invention will now be explained on the basis of FIGS. 3 and 4, with the same reference signs as those used in FIGS. 1 and 2 being used to designate identical components. FIG. 3 is a sectional view along the section plane C-C, in which the longitudinal axis I of the passage bore 14*a* also lies, from FIG. 4. As can be seen from this, the passage bore 14*a* runs obliquely through the armature 13. In other words, according to the invention, the axial direction, that is to say the longitudinal axis I of the throughflow bore 14*a* is skewed in relation to the longitudinal axis H which runs through the center of the needle 11. In this case, the longitudinal axis H simultaneously constitutes the central axis of the central bore 13*a*, through which the needle 11 runs, in the armature 13. That is to say, the inlet opening of the throughflow bore 14*a*, which in FIG. 3 is depicted in the upper region of the armature 13, is situated closer to the longitudinal axis H than the outlet opening of the throughflow bore 14*a*, which is depicted in FIG. 3 in the lower region of the armature 13. The distance a between the inlet opening and the central axis H is thus smaller than the distance b between the outlet opening of the throughflow bore 14*a* and the central axis H. The distances a and b are measured from the central point of the inlet opening from the central point of the outlet opening, respectively, to the central axis H. An outlet opening is illustrated in FIG. 4 by the dashed circle with a central point $M_A$.

Figure 4:
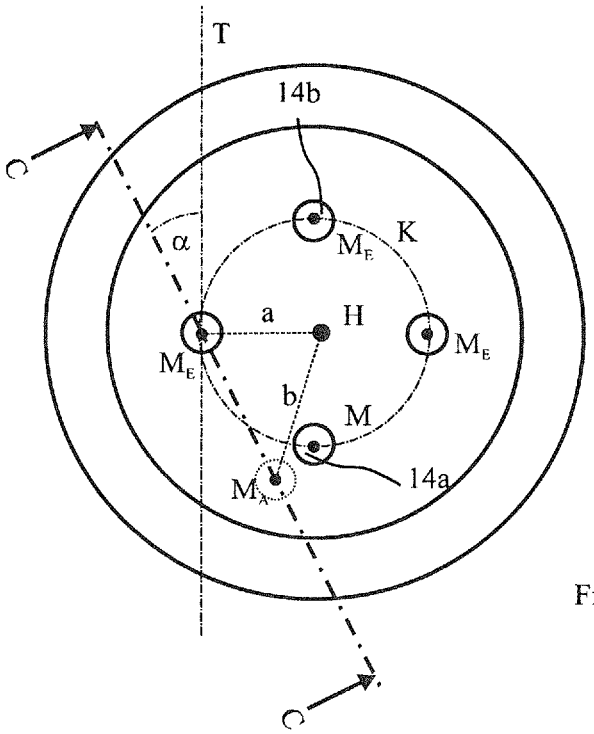
FIG. 4 depicts a sectional view, along the section plane D-D of FIG. 3, of an injection device configured in accordance with the principles of the invention.

For better explanation of the present geometrical situation, FIG. 4 illustrates a particularly preferred embodiment of the invention. This has a multiplicity of throughflow bores 14*a*, 14*b*, wherein the inlet openings are all arranged on a circular path K, the central point of which lies on the longitudinal axis H of the needle 11. The longitudinal axis I of the throughflow bore 14*a* runs in the section plane C-C which is oriented parallel to the longitudinal axis H of the needle 11. The section plane C-C and consequently also the longitudinal axis I of the throughflow bore enclose an angle a with a tangential plane T which runs tangentially with respect to the circular path K and which intersects the plane C-C at the central point ME of the inlet openings of the passage bore 14*a*. Said angle a lies in the range of ±45°, preferably in the range of ±30° and particularly preferably in the range of ±15°, in relation to the tangential plane T. That is to say, the angle of the longitudinal axis I of the passage bore 14*a* may deviate from the tangential plane T for example by +15° or by −15°.

The mode of operation of the present invention will be briefly described below on the basis of FIGS. 3 and 4. The fuel, that is to say substantially diesel or gasoline, is conducted via a fuel line into the chamber 20, as also described with reference to FIG. 1, fills the passage bore 14*a*, and the tapering region situated below the armature 13, and is present therein in a pressurized state. By means of a coil 16, a magnetic field is generated with the aid of the core 17, which magnetic field sets the armature 13 in motion. In this case, the armature 13 moves upward along the double arrow F. When the outlet openings permit a throughflow, fuel is conducted through the throughflow bores 14*a*, 14*b*, wherein, when the fuel emerges from the passage bores 14*a*, 14*b*, said fuel emerges from the throughflow bore 14*a* not in the axial direction of the needle 11 but in a direction that is skewed in relation thereto. This causes a torque to be imparted to the armature 13, whereby the latter is set in a rotational motion about its vertical axis H. Since the armature 13 is in contact with the upper stop element 12*a*, the rotational movement is also transmitted to the needle 11.

The fuel flows out of the common chamber 20 through the throughflow bores 14*a*, 14*b* into the tapering region below the armature 13, flows past the needle tip 11*a*, and emerges from the injection device 10 through the outlet openings 18 (not illustrated in FIG. 3). In this case, a rotational movement of the armature 13 is permanently generated, and thus a rotational movement of the needle 11 is also permanently generated. When the needle 11 is transferred from an open position into a closed position, the rotational movement continues, owing to the mass inertia, until the moment at which the needle tip 11*a* bears against the inner housing 5. Said rotational movement is stopped at the time at which the needle tip abuts against the region E in the interior of the housing 15. In this way, the sealing surface or the sealing region E is cleaned of contaminants every time it is abutted against by the needle 11.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An injection device for an internal combustion engine, the injection device comprising:

a fuel injection housing having a fuel outlet via which fuel is injected into an air admixing chamber or a combustion chamber;

a needle having a tip that abuts the injection housing at the fuel outlet; and an armature operatively connected to the needle such that the needle is movable by way of the armature, wherein the armature has at least one passage bore through which fuel is conducted to the needle tip, wherein a longitudinal axis of the needle and a longitudinal axis of the passage bore are in a skewed orientation relative to one another such that fuel conducted through the passage bore causes the armature and the needle to rotate about the longitudinal axis of the needle as the needle tip abuts the injection housing at the fuel outlet, and wherein the needle is provided in a centrally arranged bore of the armature.

2. The injection device as claimed in claim 1, wherein the passage bore comprises an inlet opening and an outlet opening in the armature, and wherein a distance between the inlet opening and the longitudinal axis of the needle is smaller than a distance between the outlet opening and the longitudinal axis of the needle.

3. The injection device as claimed in claim 1, wherein the injection device is in the form of a coil-type injector.

4. The injection device as claimed in claim 1, wherein the armature has a multiplicity of passage bores which are arranged radially on a circular path around a centrally situated longitudinal axis of the needle, wherein the longitudinal axis of the passage bore encloses an acute angle with a tangential plane of the circular path.

5. The injection device as claimed in claim 2, wherein the armature has a multiplicity of passage bores which are arranged radially on a circular path around a centrally situated longitudinal axis of the needle, wherein the longitudinal axis of the passage bore encloses an acute angle with a tangential plane of the circular path.

6. The injection device as claimed in claim 3, wherein the armature has a multiplicity of passage bores which are arranged radially on a circular path around a centrally situated longitudinal axis of the needle, wherein the longitudinal axis of the passage bore encloses an acute angle with a tangential plane of the circular path.

7. The injection device as claimed in claim 4, wherein the acute angle lies in the range of ±45°.

8. The injection device as claimed in claim 7, wherein the acute angle lies in the range of ±30°.

9. The injection device as claimed in claim 8 wherein the acute angle lies in the range of ±15°.

10. The injection device as claimed in claim 5, wherein the acute angle lies in the range of ±45°.

11. The injection device as claimed in claim 10, wherein the acute angle lies in the range of ±30°.

12. The injection device as claimed in claim 11, wherein the acute angle lies in the range of ±15°.

13. An injection device for an internal combustion engine, the injection device comprising:

a needle having a tip that abuts an injection device housing at a fuel outlet of the housing; and an armature which is operatively connected to the needle such that a movement of the needle can be generated by way of a movement of the armature, wherein the armature has at least one passage bore through which fuel can be conducted to a needle tip, and wherein a longitudinal axis of the needle and a longitudinal axis of the passage bore are in a skewed orientation relative to one another, wherein the passage bore comprises an inlet opening and an outlet opening in the armature, and wherein a distance between the inlet opening and the longitudinal axis of the needle is smaller than a distance between the outlet opening and the longitudinal axis of the needle.

* * * * *